US007570903B2

(12) United States Patent
Choi et al.

(10) Patent No.: US 7,570,903 B2
(45) Date of Patent: Aug. 4, 2009

(54) TONER CARTRIDGE HAVING CONTROL BOARD MOUNTED THEREIN AND ELECTROPHOTOGRAPHIC IMAGE FORMING APPARATUS USING THE SAME

(75) Inventors: Sam-seok Choi, Suwon-si (KR); Jeong-hun Pang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/216,020

(22) Filed: Jun. 27, 2008

(65) Prior Publication Data

US 2008/0267671 A1 Oct. 30, 2008

Related U.S. Application Data

(63) Continuation of application No. 11/368,620, filed on Mar. 7, 2006, now Pat. No. 7,395,016.

(30) Foreign Application Priority Data

Jun. 27, 2005 (KR) ..... 10-2005-0055895

(51) Int. Cl.
*G03G 15/08* (2006.01)

(52) U.S. Cl. ..... 399/262; 399/90; 399/106

(58) Field of Classification Search ..... 399/111, 399/262, 119, 120, 110, 107, 90
See application file for complete search history.

(56) References Cited

U.S. PATENT DOCUMENTS

| | | | | |
|---|---|---|---|---|
| 4,873,549 | A | 10/1989 | Tada et al. | |
| 5,287,161 | A | 2/1994 | Matsuo et al. | |
| 5,512,988 | A | 4/1996 | Donaldson | |
| 5,648,840 | A | 7/1997 | Ikunami et al. | |
| 5,835,817 | A | 11/1998 | Bullock et al. | |
| 5,960,238 | A * | 9/1999 | Ohgami | 399/262 X |
| 6,501,913 | B2 | 12/2002 | Hattori et al. | |
| 6,826,380 | B2 | 11/2004 | Karakama et al. | |
| 6,898,380 | B2 | 5/2005 | Takiguchi | |
| 7,010,250 | B1 | 3/2006 | Yahagi | |
| 7,395,016 | B2 * | 7/2008 | Choi et al. | 399/262 |
| 2002/0102112 | A1 | 8/2002 | Hsu | |
| 2003/0170042 | A1 | 9/2003 | Okamoto et al. | |
| 2005/0201773 | A1 | 9/2005 | Matsubara et al. | |
| 2005/0286936 | A1 | 12/2005 | Huang et al. | |
| 2006/0024080 | A1 | 2/2006 | Chadani et al. | |

FOREIGN PATENT DOCUMENTS

| | | |
|---|---|---|
| JP | 03-075786 | 3/1991 |
| JP | 04-140761 | 5/1992 |
| JP | 2004-020910 | 1/2004 |
| KR | P1993-0023783 | 12/1993 |
| KR | P1997-0049113 | 7/1997 |
| KR | 1020030028426 A | 4/2003 |
| KR | 1020040083134 | 10/2004 |

* cited by examiner

*Primary Examiner*—Sophia S Chen
(74) *Attorney, Agent, or Firm*—Roylance, Abrams, Berdo & Goodman, L.L.P.

(57) ABSTRACT

A toner cartridge has a control board mounted therein and an electrophotographic image forming apparatus using the same. The toner cartridge includes a toner tube having a mounting part on which a control board is mounted, a control board cover for covering the mounting part to mount the control board therein, and a sealing cover for sealing the toner tube.

18 Claims, 4 Drawing Sheets

TONER CARTRIDGE HAVING CONTROL BOARD MOUNTED THEREIN AND ELECTROPHOTOGRAPHIC IMAGE FORMING APPARATUS USING THE SAME

CROSS-REFERENCE TO RELATED PATENT APPLICATION

This application claims the benefit under 35 U.S.C. § 119 (a) of Korean Patent Application No. 10-2005-0055895, filed on Jun. 27, 2005, in the Korean Intellectual Property Office, the entire disclosure of which is hereby incorporated by reference. This application is a continuation of U.S. application Ser. No. 11/368,620 filed Mar. 7, 2006, to be issued as U.S. Pat. No. 7,395,016, which is hereby incorporated by reference.

BACKGROUND OF THE INVENTION

1. Field of the Invention

The present invention relates to a toner cartridge and an electrophotographic image forming apparatus. More particularly, the present invention relates to a toner cartridge having a control board mounted therein and an electrophotographic image forming apparatus using the same.

2. Description of the Related Art

In general, an image forming apparatus irradiates light onto a photosensitive medium charged to a uniform potential to form an electrostatic latent image corresponding to a desired image on the photosensitive medium, develops the electrostatic latent image using a toner to form a toner image, and transfers and fuses the toner image onto a sheet of paper, thereby forming the desired image.

A multi-color image forming apparatus generally requires yellow (Y), magenta (M), cyan (C), and black (K) toners. These color toners overlap each other to form a desired multi-color image. Accordingly, the multi-color image forming apparatus requires four developing cartridges for storing the respective color toners.

A multi-color image forming apparatus having four developing cartridges has a larger volume and a more complicated structure than a monochromic image forming apparatus for forming a single color image.

Furthermore, the developing cartridge has various components such as a developing roller for developing an electrostatic latent image as well as toner. When the toner is exhausted, the developing cartridge should be replaced with a new developing cartridge.

The life spans of the other components are longer than that of the toner. Accordingly, it is not economical to replace the developing cartridge with a new developing cartridge after the toner is exhausted, because the developing cartridge is replaced with a new developing cartridge even though the other components can still be used.

Accordingly, a method of separately supplying only a toner to use the developing cartridge until the life span of all components has been reached has been suggested. That is, the toner cartridge in which the toner is stored and the developing cartridge are separated, and, when the toner is exhausted, the toner cartridge is replaced with a new toner cartridge to supply the new toner. Thus, the developing cartridge is continuously used for the life span of the developing components.

This toner cartridge has a control board which can detect the life span of the toner. The toner board detects the depletion of toner stored in the toner cartridge and the other information regarding the toner cartridge and is generally attached to the outside of the toner cartridge.

The control board attached to the outside of the toner cartridge may be damaged by external impact due to, for example, a user's carelessness, and may be bumped against the other components when mounting or dismounting the toner cartridge. Also, the control board may be contaminated with foreign substances.

Accordingly, there is a need for an improved toner cartridge with a control board that is protected from external impacts, and an electrophotographic image forming apparatus using the same.

SUMMARY OF THE INVENTION

An aspect of the present invention is to address at least the above problems and/or disadvantages and to provide at least the advantages described below. Accordingly, an aspect of the present invention is to provide a toner cartridge in which a control board is mounted so that the control board can be protected from external impact and an electrophotographic image forming apparatus using the same.

According to an aspect of the present invention, a toner cartridge includes a toner tube having a mounting part on which a control board is mounted, a control board cover for covering the mounting part to mount the control board therein, and a sealing cover for sealing the toner tube.

In the exemplary embodiment, the control board cover may include an opening through which a contact part of the control board is exposed to the outside.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
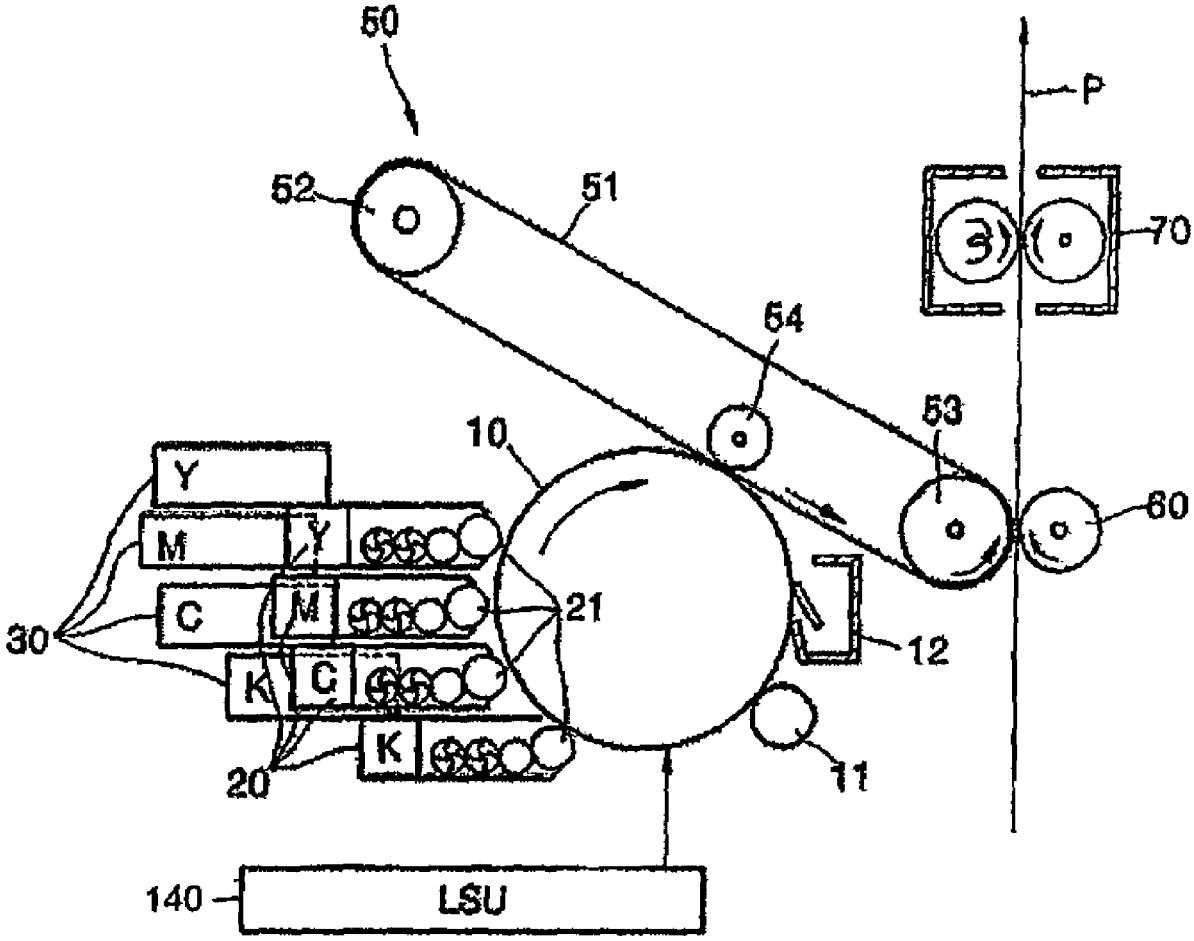
FIG. 1 is a schematic diagram of an electrophotographic image forming apparatus having a developing cartridge using a conveying means according to an exemplary embodiment of the present invention.

Referring to FIG. 1, an image forming apparatus includes a photosensitive drum 10, a plurality of developing cartridges 20, a plurality of toner cartridges 30, an intermediate transfer belt assembly 50 with an intermediate transfer belt 51, a first transfer roller 54, a second transfer roller 60, and a fusing unit 70.

The photosensitive drum 10 has a photoconductive layer formed on its outer circumferential surface. Instead of the photosensitive drum 10, a photosensitive belt may be employed. A charging roller 11, which is an example of a charger, is disposed adjacent to the outer circumferential surface of the photosensitive drum 10 to charge the photosensitive drum 10 to a uniform potential. A cleaning means 12 removes any toner that remains on the photosensitive drum 10 after transfer.

The charging roller 11 charges the photosensitive drum 10 while rotating in contact with or without contacting the outer circumferential surface of the photosensitive drum 10 to make the outer circumferential surface of the photosensitive drum 10 have a uniform potential. Instead of the charging roller 11, a corona charger may be employed.

An exposure unit 140 irradiates light corresponding to image information onto the photosensitive drum 10 charged to the uniform potential to form an electrostatic latent image. The exposure unit 140 generally includes a laser scanning unit (LSU) using a laser diode as a light source.

The plurality of toner cartridges 30Y, 30M, 30C, and 30K contain yellow (Y), magenta (M), cyan (C), and black (K) toners, respectively. The plurality of developing cartridges 20Y, 20M, 20C, and 20K receive the respective color toners from the plurality of the toner cartridges 30Y, 30M, 30C, and 30K to develop the electrostatic latent image formed on the photosensitive drum 10.

Each of the plurality of the developing cartridges 20 includes a developing roller 21 that is spaced from the photosensitive drum 10 by a developing gap. It is preferable that the development gap can be several tens or several hundreds of micron.

The image forming apparatus according to the exemplary embodiment of present invention is a multi-pass type image forming apparatus in which the plurality of the developing cartridges 20Y, 20M, 20C, and 20K sequentially operate to form an image. In this multi-pass type image forming apparatus, a developing bias may be applied to the developing roller 21K of a selected developing cartridge 20K while either no developing bias or a development preventing bias is applied to the developing rollers 21Y, 21M, and 21C of the other developing cartridges 20Y, 20M, and 20C. Alternatively, only the developing roller 21 of the selected developing cartridge 20K may rotate and the developing rollers 21 of the other developing cartridges 20Y, 20M, and 20C may not rotate.

Figure 2:
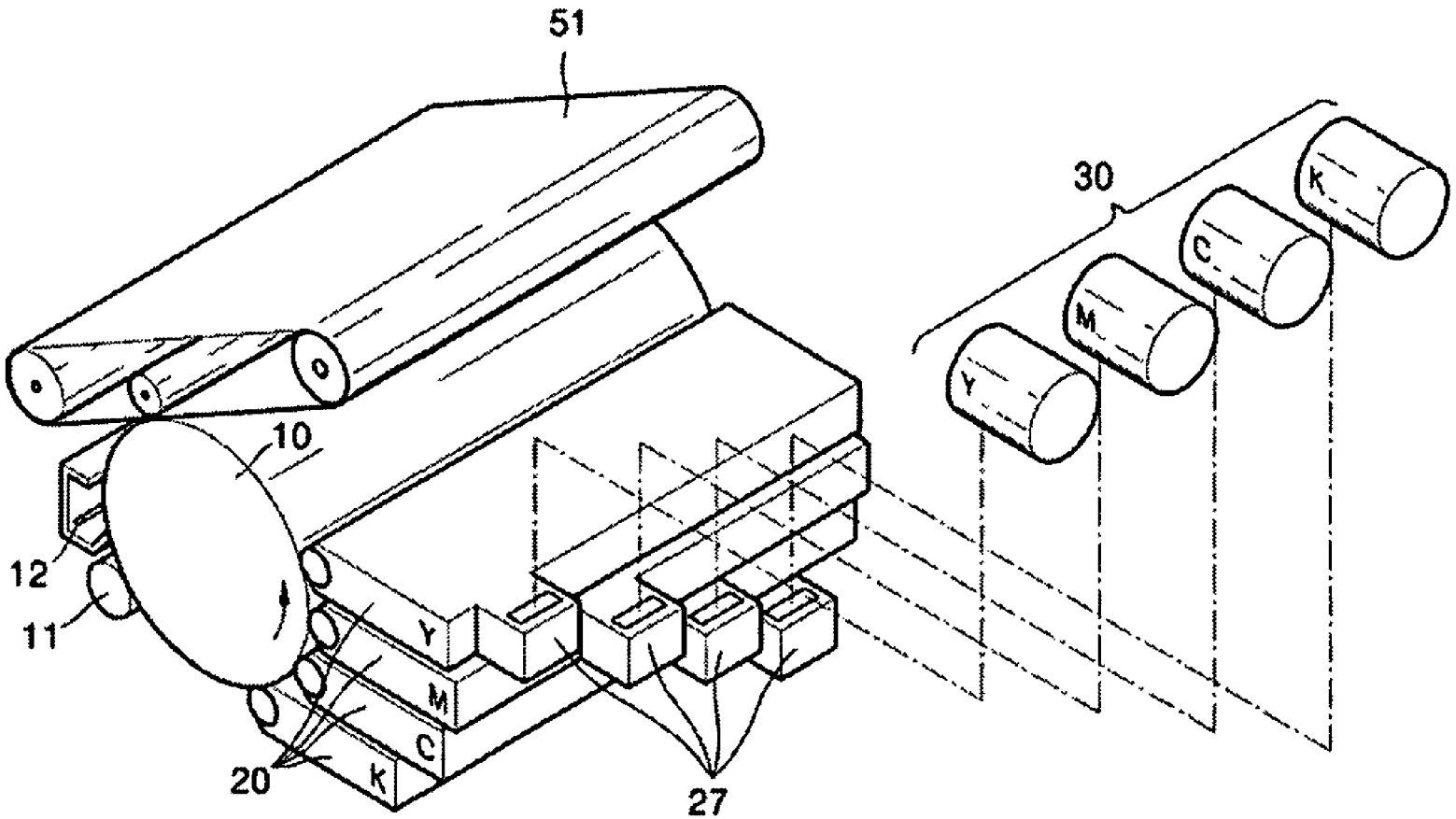
FIG. 2 is a perspective view of the arrangement of toner supplying units of a plurality of developing cartridges shown in FIG. 1.

As shown in FIG. 2, the plurality of the developing cartridges 20Y, 20M, 20C, and 20K are disposed in parallel in a travel direction of the photosensitive drum 10. Toner supplying units 27 of the plurality of the developing cartridges 20Y, 20M, 20C, and 20K are offset from each other in a lengthwise direction so that the plurality of the toner cartridges 30Y, 30M, 30C, and 30K do not interfere with each other. With this arrangement, the height of the image forming apparatus can be minimized.

Figure 3:
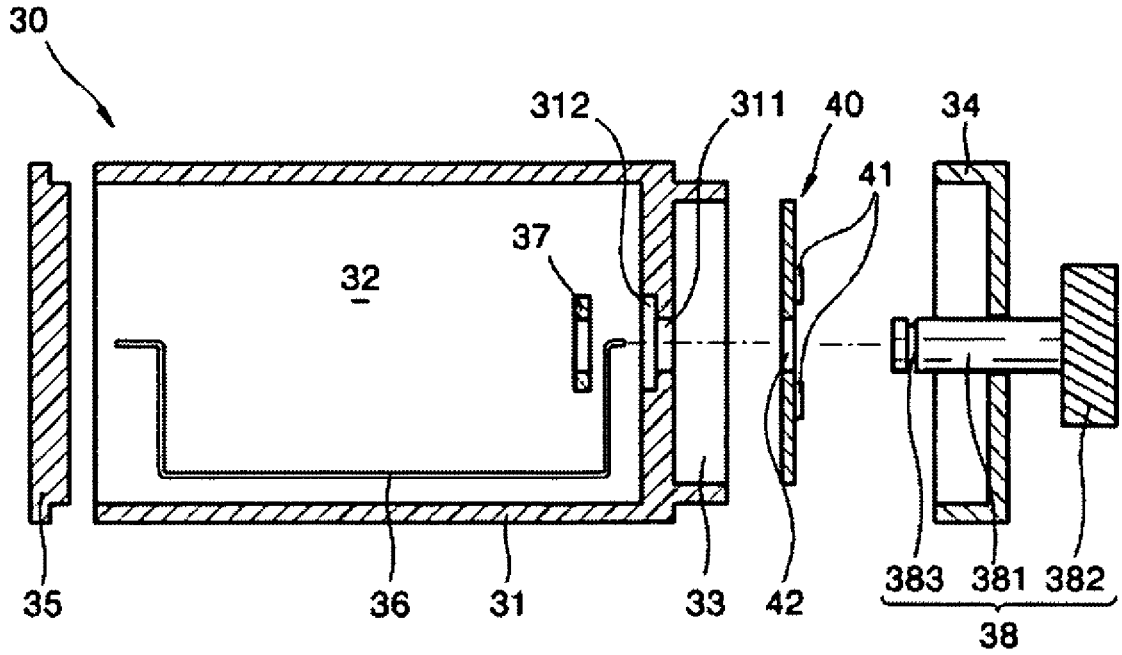
FIG. 3 is an exploded cross-sectional view of a toner cartridge having a control board mounted therein according to an exemplary embodiment of the present invention.
Figure 4:
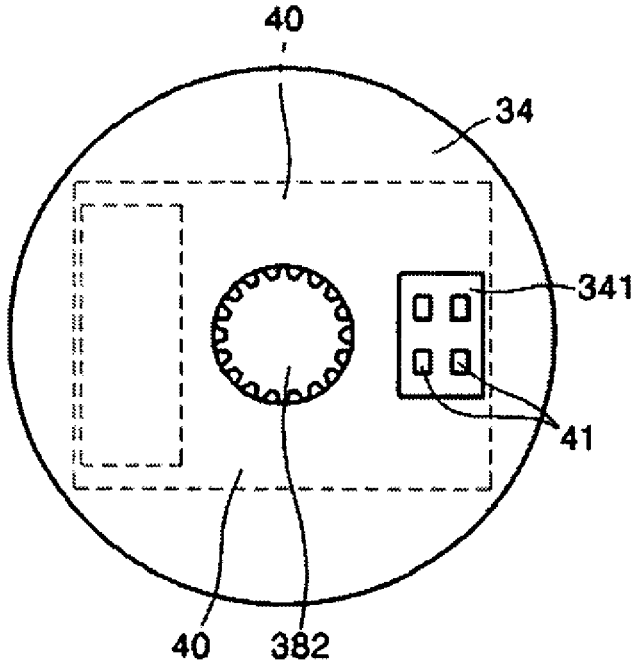
FIG. 4 is a front view of the toner cartridge shown in FIG. 3.

The plurality of the toner cartridges 30Y, 30M, 30C, and 30K may be disposed on the developing cartridges 20Y, 20M, 20C, and 20K without interfering with one another. Each toner cartridge includes a toner tube 31, a control board cover 34, and a sealing cover 35, as shown in FIGS. 3 and 4.

One side of the toner tube 31 is opened and a toner storing part 32 for receiving a toner is provided in the toner tube 31. The other side of the toner tube 31 is closed and a mounting part 33 for mounting a control board 40 is provided at the outside of the toner tube 31. The control board 40 may be fixed to the mounting part 33.

The control board cover 34 is coupled to the toner tube 31 while covering the mounting part 33 so that the control board 40 is mounted in the mounting part 33. The control board cover 34 is fused to the toner tube 31 by applying heat to the coupled portion or bonded to the toner tube 31 by using an adhesive. Since the toner tube 31 and the control cover 34 are generally made of plastic, they are easily fused or bonded to each other.

The control board cover 34 further includes an opening 341 through which contact parts 41 of the control board 40 are exposed to the outside. Accordingly, when the control board 40 is mounted on the mounting part 33 and then the control board cover 34 is put on the mounting part 33, the contact parts 41 are exposed to the outside through the opening 341.

The sealing cover 35 blocks the toner storing part 32 from the outside. After the sealing cover 35 is inserted into one side (opened side) of the toner tube 31, the sealing cover 35 is fused to the toner tube 31 by applying heat to the coupled portion or bonded to the toner tube 31 by using an adhesive. Since the sealing cover 35 is generally made of plastic, it is easily fused or bonded to the toner tube 31.

It is preferable that the control board cover 34 and the sealing cover 35 are tightly integrally coupled to the toner tube 31.

The toner cartridge 30 further includes an agitator 36 for agitating the toner (not shown) received in the toner storing part 32 and a driving unit 38 for driving the agitator 36.

The driving unit 38 includes a driving shaft 381 and a driving gear 382 which is provided at one side of the driving shaft 381 and connected to an external power source to receive power. A fixing groove 383 into which a washer 37 for fixing the other side of the driving shaft 381 to the inside of the toner tube 31 can be inserted is formed at the other side of the driving shaft 381. It is preferable that the driving gear 382 is a helical gear.

Since the teeth of helical gear are twisted at a predetermined angle with respect to the axis of the gear, axial thrust is generated. Further, hardly any vibration is generated because the gear contact area is wide.

The driving shaft 381 penetrates through the control board cover 34, the control board 40, and the toner tube 31. The control board 40 and the toner tube 31 have penetrating holes 42 and 311 through which the driving shaft 381 penetrates, respectively.

A receiving groove 312 into which the washer 37 can be inserted is formed on the inside of the toner storing part 32. As shown in FIG. 1, when the toner cartridge 30 is mounted on the developing cartridge 20 and receives power from an external power source in the state where the washer 37 is inserted into the fixing groove 383, thrust is generated in the axial direction of the driving shaft 381, and the washer 37 is tightly inserted into and closely adhered to the receiving groove 312. Thus, the receiving groove 312 and the penetrating hole 311 are sealed so that the toner received in the storing part 32 is prevented from leaking to the outside and the control board 40 is prevented from being contaminated by the toner. This effect can be obtained by using the helical gear as the driving gear 382.

In an exemplary embodiment, the opening 341 of the control board cover 34 and the driving unit 38 are provided at a same side of the toner tube 31. That is, the opening 341 of the control board cover 34 can be provided at the side of the driving gear 382, in order to conveniently mount the toner cartridge 30 on the developing cartridge 20. If the opening 341 and the driving unit 38 are provided at different sides of the toner tube 31, the control board 40 and the driving unit 38 are connected in different directions, respectively, thereby imposing limitations on the mounting arrangement.

Figure 5:
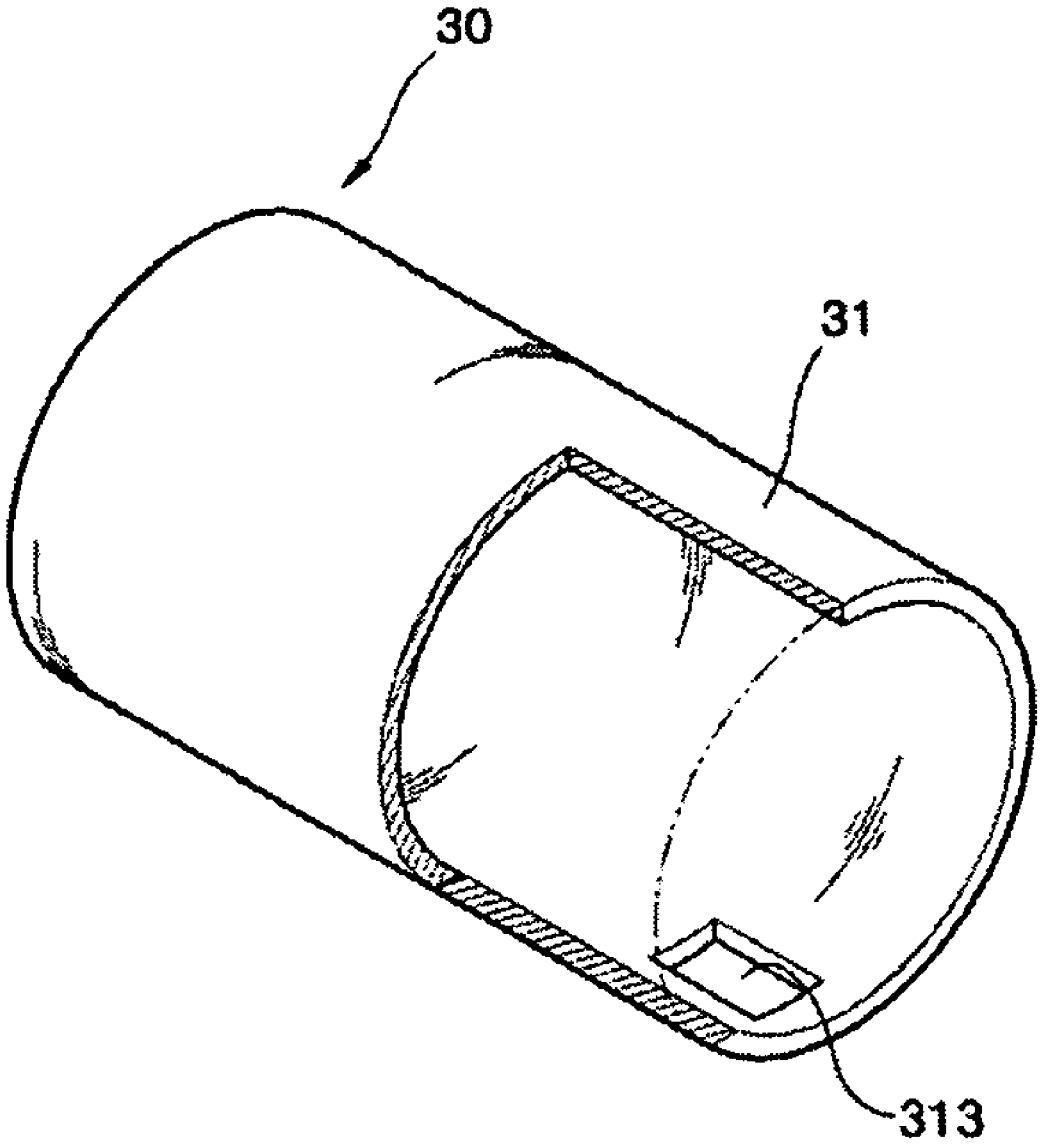
FIG. 5 is a partial perspective view of the toner cartridge shown in FIG. 3.

As shown in FIG. 5, the toner cartridge 30 includes a toner outlet 313 through which the toner is introduced into the developing cartridge 20 after being mounted on the image forming apparatus, at a surface facing the developing cartridge 20. The toner outlet 313 is opened or closed by a shutter (not shown). That is, when the toner cartridge 30 is mounted on the developing cartridge 20, the toner outlet 313 is opened, and, when the toner cartridge 30 is separated from the developing cartridge 20, the toner outlet 313 is closed to prevent toner from flowing out.

A method of assembling the toner cartridge 30 will now be described.

First, the control board 40 is mounted on the mounting part 33 of the toner tube 31, and then the control board cover 34 is inserted into the toner tube 31 to mount the control board in the toner tube 31. Then, the coupled portion of the control board cover 34 and the toner tube 31 are fused or bonded to be integrally coupled to each other.

After the driving unit 38 penetrates through the control board cover 34, the control board 40, and the toner tube 31, the washer 37 is inserted into and fixed to the fixing groove 383.

At this time, the agitator 36 may be fixed to the driving shaft 381 before or after the washer 37 is inserted into the fixing groove 383.

Next, the sealing cover 35 is inserted into the opened side of the toner tube 31 and then the coupled portion is fused or bonded to be integrally coupled to each other.

To disassemble the toner cartridge 30, the steps to assemble the toner cartridge 30 are reversed.

The intermediate transfer belt 51 is supported by supporting rollers 52 and 53 and travels at a linear travel speed equal to a linear rotating speed of the photosensitive drum 10. A length of the intermediate transfer belt 51 should be the same or longer than a length of a sheet of paper P having a maximum size, which is used in the image forming apparatus.

The first transfer roller 54 faces the photosensitive drum 10 and a first transfer bias is applied to transfer the toner image formed on the photosensitive drum 10 onto the intermediate transfer belt 51. The second transfer roller 60 faces the intermediate transfer belt 51. While the toner image is being transferred from the photosensitive drum 10 onto the intermediate transfer belt 51, the second transfer roller 60 is spaced apart from the intermediate transfer belt 51, and when the toner image is completely transferred onto the intermediate transfer belt 51, the second transfer roller 60 contacts the intermediate transfer belt 51 with a predetermined pressure. The second transfer roller 60 is applied with a second transfer bias for transferring the toner image onto the sheet.

The fusing unit 70 applies heat and pressure to the toner image transferred onto the sheet to fuse the toner image on the sheet.

As described above, in the toner cartridge having the control board mounted therein and the electrophotographic image forming apparatus using the same according to the present invention, the control board is provided in the toner cartridge and thus the toner cartridge can be prevented from being damaged due to the external impact and from malfunctioning due to contamination.

While the invention has been shown and described with reference to certain embodiments thereof, it will be understood by those skilled in the art that various changes in form and details may be made therein without departing from the spirit and scope of the invention as defined by the appended claims.

What is claimed is:

1. A control board of a toner cartridge, the toner cartridge being attached/detached to/from a developing cartridge having a developing roller, the control board being mounted on a mounting part prepared as a predetermined space on a side of a toner tube of the toner cartridge and being covered by a control board cover, wherein the control board comprises a plurality of contact parts protruding from a side thereof, and the toner cartridge comprises a sealing member installed in another side of the toner tube and sealing the toner tube from outside;

wherein the control board has a penetration hole, through which a driving shaft passes.

2. The control board of claim 1, wherein the plurality of contact parts are exposed to an outside through an opening formed in the control board cover.

3. The control board of claim 2, wherein the opening is in an eccentric location from a center of the control board cover.

4. The control board of claim 3, wherein the number of the contact parts exposed to the outside through the opening is four, and these contact parts have a grid array.

5. A method of assembling a control board of a toner cartridge, the method comprising:

(a) mounting the control board on a mounting part of the toner cartridge that stores toner;

(b) assembling a control board cover having an opening, through which contact parts of the control board can be exposed to outside, onto a toner tube of the toner cartridge; and (c) assembling a driving unit for driving an agitator that agitates the toner stored in the toner cartridge.

6. The method of claim 5, wherein in (b), the control board cover and the toner tube are integrated into one body by fusing or bonding coupling portions of the control board cover and the toner tube.

7. The method of claim 5, wherein in (c), the driving unit is assembled by penetrating through the control board cover.

8. The method of claim 7, wherein the driving unit is assembled by penetrating through the control board and the toner tube.

9. A toner cartridge comprising:

a toner tube comprising a storage unit storing a toner inside;

a sealing member installed in one side of the toner tube and sealing the storage unit from outside;

a mounting part installed in another side of the toner tube and to which a control board is mounted;

an agitator installed in the storage unit and agitating the stored toner; and a driving unit driving the agitator;

wherein the driving unit comprises a driving shaft, and a driving gear that is provided at one side of the driving shaft and connected to an external power source to receive power, and is installed to penetrate the toner tube from the mounting part, and the toner tube comprises a penetration hole through which the driving shaft penetrates.

10. The toner cartridge of claim 9, wherein the driving gear is a helical gear.

11. The toner cartridge of claim 10, wherein as the helical gear is twisted at a predetermined angle with an axis, thrust is generated in an axis direction.

12. The toner cartridge of claim 9, wherein the toner tube comprises a toner outlet through which the toner is introduced.

13. The toner cartridge of claim 12, wherein the toner outlet is adjacently disposed to the mounting part.

14. A control board for a toner cartridge as claimed in claim 9 wherein the control board is mounted on the mounting part of the toner cartridge.

15. The control board of claim 14, wherein the driving gear is a helical gear.

16. The control board of claim 15, wherein as the helical gear is twisted at a predetermined angle with an axis, thrust is generated in an axis direction.

17. The control board of claim 14, wherein the toner tube comprises a toner outlet through which the toner is introduced.

18. The control board of claim 17, wherein the toner outlet is adjacently disposed to the mounting part.

* * * * *